United States Patent [19]

Marxer

[11] Patent Number: 4,706,393

[45] Date of Patent: Nov. 17, 1987

[54] SKI BOOT FASTENER

[75] Inventor: Herbert Marxer, Schaan, Liechtenstein

[73] Assignee: Lange International S.A., Fribourg, Switzerland

[21] Appl. No.: 926,322

[22] Filed: Nov. 3, 1986

[30] Foreign Application Priority Data

Jan. 23, 1986 [CH] Switzerland ..... 267/86

[51] Int. Cl.[4] ..... A43B 5/04; A43C 11/00

[52] U.S. Cl. ..... 36/117; 36/50; 24/68 SK

[58] Field of Search ..... 36/117–121, 36/50; 24/68 SK, 69 SK, 70 SK, 71 SK

[56] References Cited

U.S. PATENT DOCUMENTS

| | | | |
|---|---|---|---|
| 4,408,403 | 10/1983 | Martin | 36/117 X |
| 4,596,080 | 6/1986 | Benoit et al. | 36/120 |

FOREIGN PATENT DOCUMENTS

| | | | |
|---|---|---|---|
| 0186197 | 7/1986 | European Pat. Off. | 36/117 |
| 0188818 | 7/1986 | European Pat. Off. | 36/117 |
| 3506057 | 2/1986 | Fed. Rep. of Germany | 36/117 |
| 3532455 | 4/1986 | Fed. Rep. of Germany | 36/117 |
| 2448872 | 9/1980 | France | 36/117 |

*Primary Examiner*—James Kee Chi

*Attorney, Agent, or Firm*—Kane, Dalsimer, Kane, Sullivan and Kurucz

[57] ABSTRACT

This ski boot fastener comprises a stretching lever having pivotally mounted therein at least two nipples each fulcrumed on a crosspin, and boot closing cables having each one end passing through the corresponding nipple and anchored to a cable head or socket movable along the cable and reacting against the corresponding nipple. The head or socket consists of an internally screw-threaded tube engaged by an externally screw-threaded core soldered to the cable end. The adjustment is obtained by rotating the socket.

10 Claims, 11 Drawing Figures

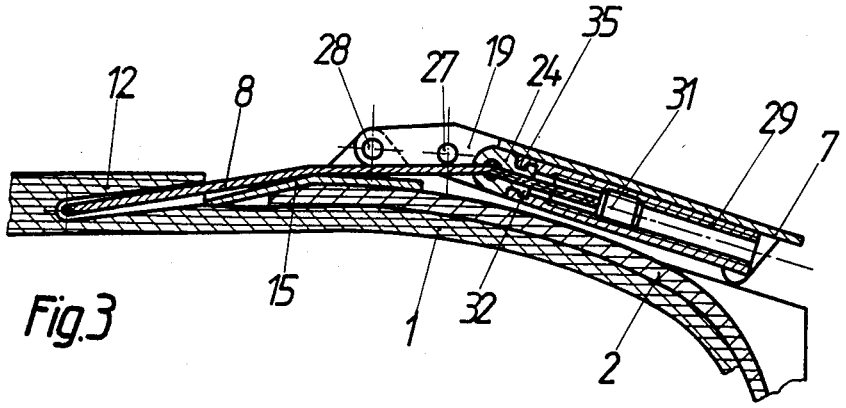
Fig.3
Fig. 7
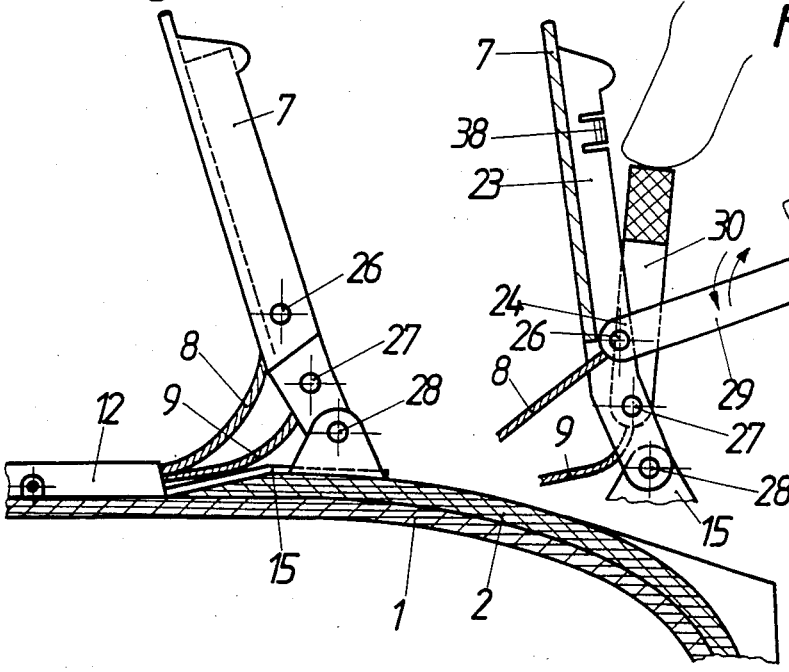
Fig. 8
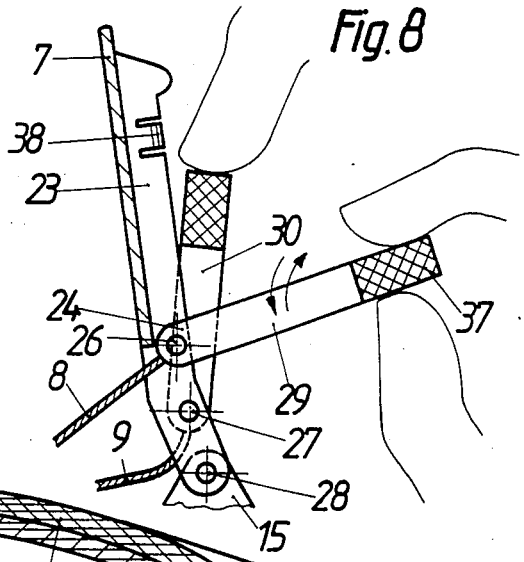

Fig. 4
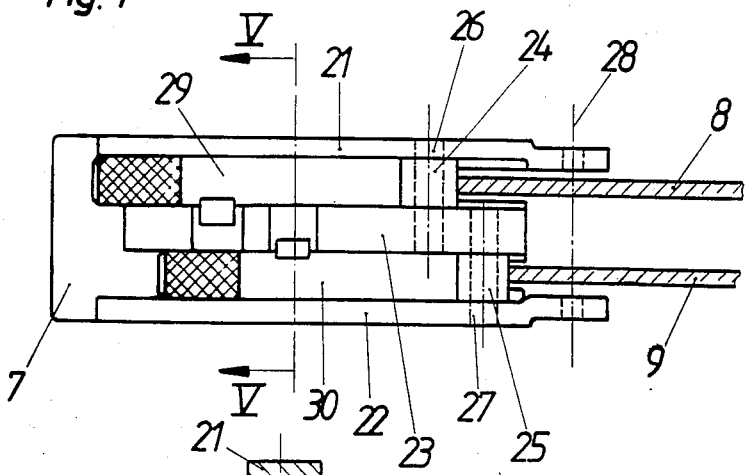
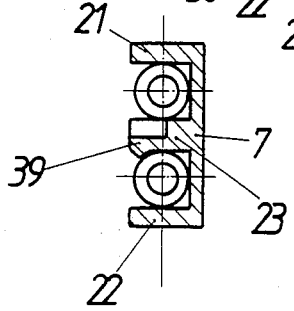
Fig. 5
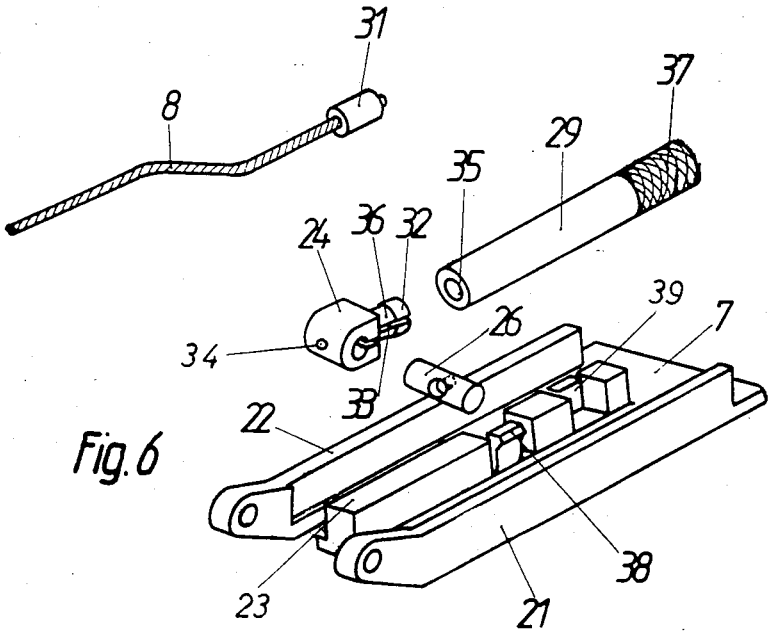
Fig. 6

SKI BOOT FASTENER

FIELD OF THE INVENTION

This invention relates in general to sports foot-wears and has specific reference to an improved fastener for releasably closing a sports boot, notably a ski boot, this fastener comprising essentially stretching means attached to one side of the boot and adapted to actuate cables having one end anchored to the other side of the boot.

THE PRIOR ART

A boot comprising a device of this character is disclosed in the U.S. Pat. No. 3,570,148. In this device the two ends of each cable are attached to the top or covering flap of the boot and constitute a relatively short loop engaging the notch of a stretching or control lever pivoted to the adjacent side of the boot in the general plane of symmetry of the loop. The stretching lever extends downwards and its length is therefore limited by the boot height in the foot area. Under these conditions, a considerable effort must be exerted for properly tightening the boot, inasmush as the cable action is exerted at two spaced points simultaneously. Moreover, the control lever applies the same force at two tightening points, whereas the user under certain circumstances might wish to differentiate the tightening pressure at the two cable anchoring points. Finally, the fine adjustment of the cable length, that is, of the tightening force, is obtained by means of nuts disposed at the cable end anchoring points.

In another known and similar arrangement disclosed in the Swiss Pat. No. A-4O6901 the cable ends are secured to the same portion of the shell as the stretching lever, the cable forming three loops of which two pass around hook means secured to the other boot portion. However, this boot exhibits the same inconveniences as the one mentioned in the preceding paragraph.

SUMMARY OF THE INVENTION

It is the essential object of the present invention to provide a cable-type fastener adapted to be closed by exerting only a reduced effort and wherein the tightening forces are adjustable separately for each cable anchor-point. The reduction of the effort necessary for tensioning each cable further permits of stretching a plurality of cables simultaneously by actuating a single lever, that is, in a single operation.

For this purpose, in the fastening device according to the present invention the cable ends are attached independently of one another to the stretching or control lever, and if desired the distances from the cable anchor points to the fulcrum of the actuating lever may differ, so that a differential action is exerted on the cables and furthermore these tensions can be adjusted separately.

According to a specific form of embodiment of the present invention, the control lever is splitted into two parallel levers actuatable independently of each other in a predetermined order, one lever being provided with an ear adapted to drive the other lever simultaneously during the closing movement of said one lever. With this arrangement, the control lever may consist in fact of three, four or more levers. In addition, the double lever system further enhances the possibilities of adjusting the tightening effort according to the skier's convenience.

This invention is also directed to provide an improved ski boot equipped with the fastener or stretching device broadly described hereinabove.

Two typical forms of embodiment of the invention will now be described with reference to the attached drawings.

THE DRAWINGS

FIG. 3 is a section taken along line III—III of FIG. 1;

FIG. 4 is a view from inside the stretching lever,

FIG. 5 is a section taken along the line V—V of FIG. 4,

Figure 1:
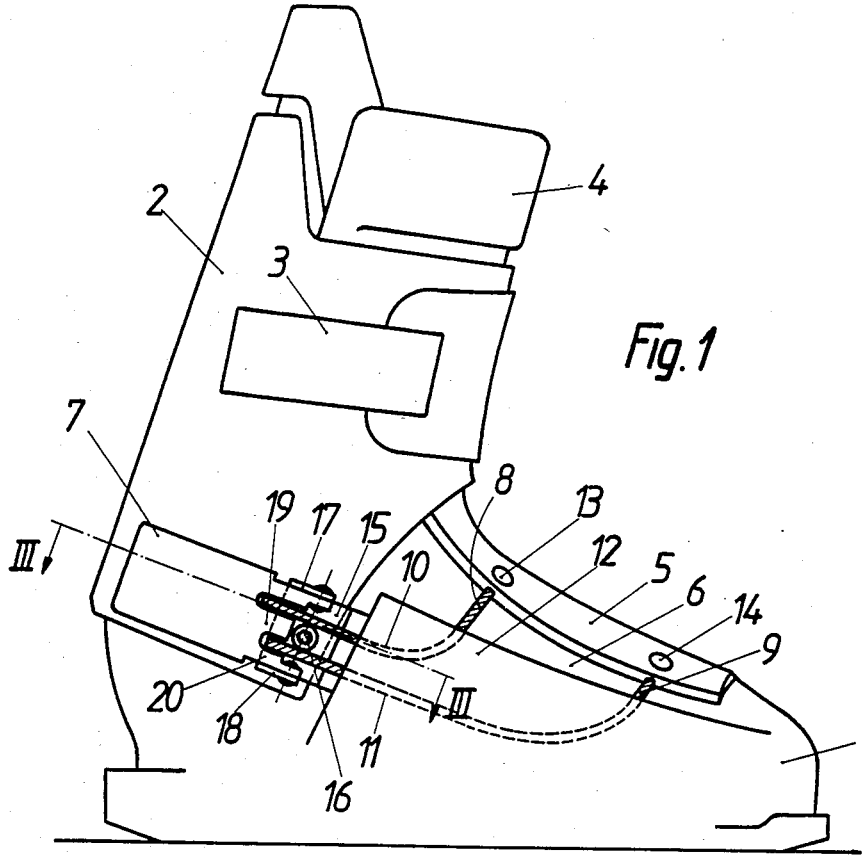
FIG. 1 shows in side elevational view a ski boot provided with the fastener according to a first form of embodiment of the invention.
Figure 2:
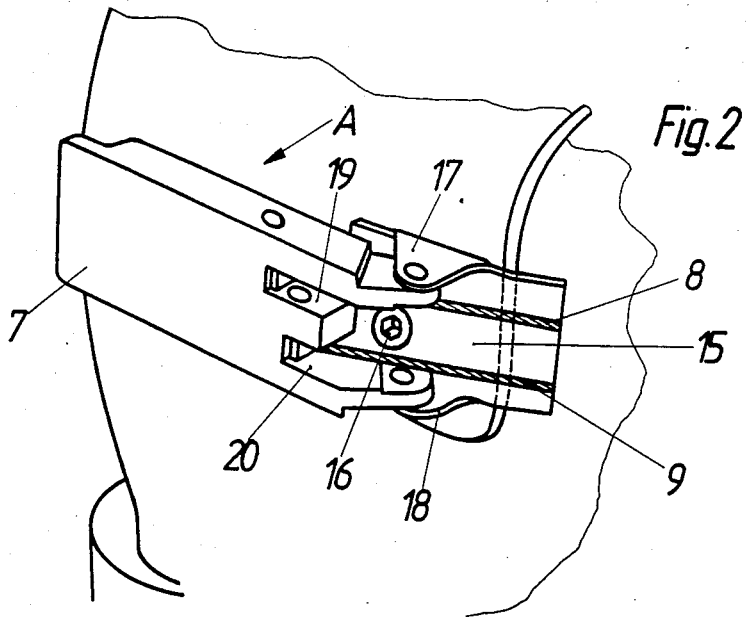
FIG. 2 is a perspective and fragmentary view of the stretching lever incorporated in this first form of embodiment.
Figure 9:
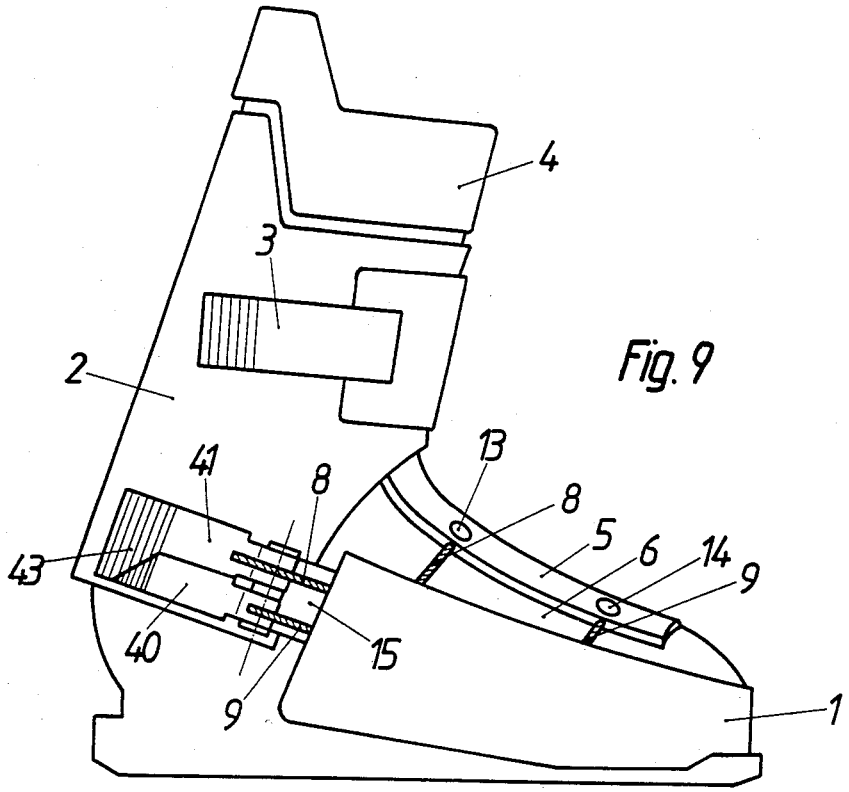
Figure 10:
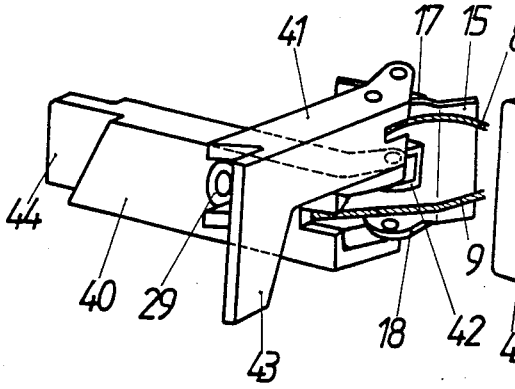
Figure 11:
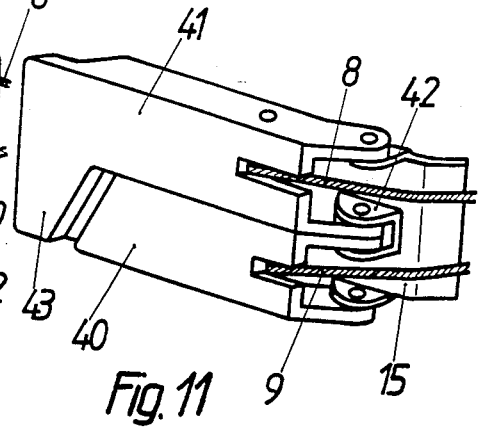

FIG. 6 is an exploded view of the stretching lever according to the first form of embodiment, showing only one cable and the means for anchoring and adjusting this cable, FIG. 7 is a part-sectional and top view of a detail of FIG. 1, showing the stretching lever in its boot-opening position, FIG. 8 illustrates the adjustment of the stretching lever, FIG. 9 is a diagrammatic side elevational view showing a ski boot provided with a modified form of embodiment of the fastener of this invention, FIG. 10 is a perspective view of the stretching lever of the second form of embodiment, shown in its half-open position, and FIG. 11 is a perspective view of the same stretching lever in its fully closed position.

DESCRIPTION OF THE PREFERRED EMBODIMENTS

The ski boot shown in FIG. 1 consists, in a manner known per se, on one hand of a shell 1 of synthetic material constituting the sole and surrounding the skier's foot and heel, and on the other hand of a shaft 2 closed at its front quarter by a fastener 3. An inner slipper 4 is encompassed by the shell 1 and shaft 2. The top of the shell 1, or instep, consists of a pair of overlapping flaps 5, 6, thus ensuring a reliable and fluid-tight closing of the shell and a proper tightening of the foot in the boot. The means for closing the flaps 5, 6 and adjusting the tightening force exerted on the foot consist essentially of a stretching lever 7 pivoted on the shaft 2 and controlling a pair of traction cables 8, 9 guided in grooves 10, 11 formed in a thicker portion 12 of the shell 1, said cables 8, 9 having their ends attached to the upper flap 5 by means of anchor studs 13, 14, respectively, which are embedded in the synthetic material of said flap 5.

The stretching lever 7 is fulcrumed on a base plate 15 secured to the boot shaft 2 by means of a screw 16 acting at the same time as a means for pivotally mounting the shaft 2 on shell 1. This base plate 15 is provided with a pair of parallel lateral spaced lugs 17, 18 constituting a strap on which the stretching lever 7 is pivoted. This lever 7 extends backwards and is slightly inclined, as shown in FIG. 1, so as to be substantially parallel to the lower edge of shaft 2. The location and orientation of the stretching-lever fulcrum are such that a relatively long stretching lever can be used, at any rate longer than the conventional buckles, closures or fasteners disposed on the boot side and extending toward the sole, though the stretching lever of the present invention can also be disposed like conventional buckles, if desired. If the ski boot is provided with means for adjusting the lateral inclination of shaft 2, as described for example in Pat. CH No. 638,383, the plate 15 may advantageously be incorporated in these adjustment means. The stretching lever 7 has two parallel slots 19, 20 formed therein at its front end to permit the passage of cables 8 and 9 when the stretching lever 7 is opened as shown in FIG. 7.

The stretching lever 7 will now be described more in detail with reference to FIGS. 2–6 of the drawings. This stretching lever 7 has a substantially W-shaped cross-sectional configuration (FIGS. 4–6) with two lateral walls 21, 22 and a central rib 23. The cables 8, 9 are attached to stretching lever 7 by means of nipples 24, 25, respectively, adapted to pivot in the grooves formed between the side walls 21, 22 and the central rib 23 about crosspins 26, 27, respectively. These crosspins 26, 27 are disposed at different distances from the fulcrum pin 28 for pivotally mounting the stretching lever 7 on its support plate 15. The cables 8, 9 are retained on their nipples 24, 25 by means of cable sockets 29, 30, respectively. These cable sockets 29, 30 consist each of a small internally screw-threaded tube adapted to be engaged by an externally-threaded core 31 (FIG. 6) soldered to the cable 8. Of course, the other cable 9 is attached in the same manner. The nipple 24 is formed with an integral perpendicular cylindrical projection 32. Formed through the nipple 24 and its cylindrical projection 32 is a slit 33 extending from the axis of nipple 24 to the end of said projection 32 for imparting a certain resiliency to the nipple. Furthermore, the projection 32 is tubular and communicates with a radial hole 34 of nipple 24 to permit the passage of cable 8. The end of socket 29 adjacent the nipple 24 is plain (FIG. 3) but comprises a cylindrical cavity for receiving the cylindrical projection 32. The inlet 35 of this cavity has a diameter somewhat smaller than that of the remaining part of the cavity and is adapted to snappily engage a groove 36 of projection 32. The socket 29 is secured to this projection 32 by its detent-positioning in the socket end, and the socket can rotate about said cylindrical projection. On the other hand the socket 29 engages a flat face of nipple 24. This description of cable socket 29 also applies, of course, to cable socket 30. As the cable 8 cannot rotate, its core 31 can move axially in socket 29. The structure is the same for cable 9, so that the operative cable length can be adjusted at will.

To put on the ski boot, the skier moves the stretching lever away from the boot, as shown in FIG. 7. In this position, the cable sockets 29, 30 can be pulled out from stretching lever 7, as shown in FIG. 8, and the sockets of cable ends can be easily rotated by exerting a finger-tip action on their knurled ends 37, to adjust the operative lengths of the cables. When the proper adjustment is obtained, the cable end socket 29, 30 are pivoted back to their collapsed position in lever 7 and retained in this position by a pair of spring lugs 38, 39 cut in the central rib 23. The operative length of the cables can thus be adjusted separately for each cable, though a single stretching lever is used. The distances between each crosspin 26, 27 and the fulcrum pin 28 of the stretching lever are so selected that the amount of length reduction of cable 8 surrounding the skier's instep is substantially greater than the elongation or shortening of the cable acting nearer to the toe. Of course, it would also be possible to multiply the points where the cable tightening action is obtained, notably by using a third cable controllable in the same manner by means of said lever 7. If really necessary it would be possible to adjust the cables by means of their sockets 29, 30 without pulling these sockets out of their grooves in lever 7.

A modified form of embodiment will now be described with reference to FIGS. 9–11. The greater part of the ski boot shown in FIG. 9 has the same strcuture as that shown in FIG. 1 and therefore it is not deemed necessary to describe it in detail, the same component elements being designated by the same reference numerals. Only the differences existing between the two forms of embodiment will be described. The essential difference lies in the fact that the stretching lever of FIGS. 9–11 comprises two independent stretching levers 40, 41 consisting of channel members. These stretching levers 40, 41 are fulcrumed on base plate 15 secured to the ski boot shaft 2 by means of a strap 42 welded to the base plate 15 intermediate its ends, the adjacent perpendicular walls of the pair of stretching levers 40 and 41 being pivoted to this strap 42 by means of a common pin riveted to said walls. Furthermore, the outer walls of stretching levers 40 and 41 are pivoted by means of riveted pins to the lugs 17 and 18 of base plate 15. The cables 8 and 9 are attached to the stretching levers 40 and 41 in the same fashion as in the first form of embodiment. The cable 8 is attached to lever 41 by means of a cable socket 29, and the other cable 9 is attached to the stretching lever 40. The other stretching lever 41 is provided with a lateral ear 43 coplaner to the surface of this stretching lever 41 and adapted to engage a bearing surface 44 formed on the end of stretching lever 40. The stretching levers 40 and 41 can thus be actuated separately, except when they are coupled by said ear 43 of stretching lever 41. Thus, when the stretching levers are opened, it is possible to either raise in succession firstly lever 41 and then lever 40, or both levers simultaneously, if stretching lever 40 is actuated. In contrast thereto, when tightening the boot, the skier may either tilt back firstly stretching lever 40 and then stretching lever 41, or both levers simultaneously by actuating directly the stretching lever 41 alone. This half-independence of the stretching levers affords a finer adjustment of the foot tightening near its toe end at point 14 of FIG. 9 than if a single stretching lever were used. It is thus possible to adjust the foot tightening force adjacent the toe end by actuating only stretching lever 40. When a satisfactory adjustment has been obtained, the tightening force exerted at point 13 can be adjusted separately, that is, in the instep area. Conversely, the instep tightening can be relieved without altering the adjustment obtained at point 14. When the desired adjustment has been obtained, both stretching levers can be utilized as a single lever by moving stretching lever 41 in the closing direction and stretching lever 40 or both stretching levers 40 and 41 simulatneously in the opening direction. Of course, it would also be possible, according to the same principle, to provide three or more parallel control levers.

Preferably, all the component elements of the buckle assembly of the present invention are made of metal.

The tightening means comprising a single or double stretching levers have been described by way of example for closing and tightening the foot, but it would also be possible to use similar means for closing and tightening another part of the boot, for example the shaft 2. Besides, different shapes may be devised for the cable sockets or tips without departing from the basic principles of the invention.

Considering the length of the stretching levers, notably of the cable sockets 29 and 30, it is clear that a relatively considerable range of adjustment can be afforded with the present invention. Thus, it is unnecessary to have the possibility of adjusting the position of the fulcrum pin 28 of the stretching lever. However, if desired this adjustment can be contemplated and in this case a strap having a plurality of notches formed therein may be substituted for the strap illustrated, the pivot pin 28 of the stretching lever being engageable in the various notches of the strap in a release or relief position.

Of course, the boot fastener of the present invention is applicable to many types of sports footwears, notably cross-country ski boots or skating boots.

The embodiments of the invention in which an exclusive property of privilege is claimed are defined as follows:

1. Fastener for releasably closing two portions of a sports boot, which comprise stretching means attached to one portion of the boot and adapted to control a pair of cables (8, 9) having one end anchored to the other portion of the boot, wherein said stretching means consist of at least one stretching lever (7, 40, 41) with at least two cable nipples (24, 25) each pivoted by means of a crosspin (26) on said stretching lever (7) and provided with a diametral hole (34) through which the cable (8, 9) is passed, the cable ends being each anchored to a tapped socket (29, 30) movable along the cable and reacting against said nipple.

2. The boot fastener of claim 1, wherein said nipples (24, 25) are disposed at different distances from the pivot axis (16) of said lever.

3. The boot fastener of claim 2, wherein said stretching lever (7) consists of at least two parallel stretching levers (40, 41) fulcrumed on a common pivot pin but adapted to pivot independently of each other, one (41) of said stretching levers comprising a lateral portion (43) covering at least partially the other stretching lever or levers (40) in its fastener closing position, so that closing the covering stretching lever (41) will simultaneously close the covered stretching lever (40), and that opening the covered stretching lever will simultaneously open the covering stretching lever (41).

4. The boot fastener of claim 1, wherein the cable ends at the buckle end of the cables consist each of an elongated member (29, 30) formed with an axial, internally screw-threaded bore engageable by an externally screw-threaded core (31) to which the cable end proper is secured for example by soldering.

5. The boot fastener of claim 4, wherein said cable nipples (24, 25) are provided with a cylindrical guide extension (32) engageable in the axial bores of said elongated merbers (29, 30).

6. The boot fastener of claim 5, wherein said cable-end forming elongated members (29, 30) are each coupled to said cylindrical guide extension (32) by mutual snap engagement.

7. The boot fastener of claim 6, wherein said cable nipples (24, 25) and their cylindrical guide extensions (32) consist each of an integral element provided with a slit (33) for imparting a certain elasticity thereto, said slit (33) extending diametrally to the corresponding nipple, said nipple having an annular external groove (36) engageable by the narrower end of the axial bore of said elongated member (29).

8. The boot fastener according to any of claims 1–7, wherein said cable ends (29, 30) are adapted to pivot independently of each other with their nipples about their transverse pivot axis for angular movement away from the corresponding stretching lever for adjustment purpose, or toward said stretching lever so as to collapse in said stretching lever.

9. The boot fastener according to any of claims 1–7, wherein said stretching lever is fulcrumed on a strap by means of a pivot pin engaging notches formed in said strap, whereby the pivot pin of said stretching lever can be released from said notches in the release position.

10. Ski boot comprising a shell of rigid or semi-rigid material, which consists of a lower portion (1) forming the sole, heel and instep, and a shaft (2) pivoted to said lower portion, the instep comprising a pair of flaps (5, 6) overlapping each other to permit the tightening of the skier's foot, and foot tightening means comprising at least two cables (8, 9) having one end attached to said shell, at least to the lower portion thereof, and stretching means controlling the cable tension, wherein said tightening means comprise at least one stretching lever (7; 40, 41) fulcrumed on the shell side in the ankle area, said stretching lever extending toward the boot heel and comprising at least two nipples (24, 25) each pivoted on a pivot axis extending across said lever and provided with a diametral hole (34) for receiving the cable (8, 9), the cable ends being each attached to a head (29, 30) movable along said cable for adjustment purpose and adapted to react against said nipple.

* * * * *